US011486081B2

(12) United States Patent
Pattarello et al.

(10) Patent No.: US 11,486,081 B2
(45) Date of Patent: Nov. 1, 2022

(54) LAUNDRY APPLIANCE WITH USER SENSING FUNCTIONALITY

(71) Applicant: Electrolux Appliances Aktiebolag, Stockholm (SE)

(72) Inventors: Giorgio Pattarello, Porcia (IT); Federico Del Maschio, Porcia (IT)

(73) Assignee: Electrolux Appliances Aktiebolag

( * ) Notice: Subject to any disclaimer, the term of this patent is extended or adjusted under 35 U.S.C. 154(b) by 92 days.

(21) Appl. No.: 16/977,997

(22) PCT Filed: Mar. 7, 2018

(86) PCT No.: PCT/EP2018/055680

§ 371 (c)(1),
(2) Date: Sep. 3, 2020

(87) PCT Pub. No.: WO2019/170232

PCT Pub. Date: Sep. 12, 2019

(65) Prior Publication Data

US 2021/0071347 A1 Mar. 11, 2021

(51) Int. Cl.
*D06F 58/34* (2020.01)
*D06F 103/10* (2020.01)
(Continued)

(52) U.S. Cl.
CPC ..... *D06F 58/34* (2020.02); *D06F 34/14* (2020.02); *D06F 34/18* (2020.02); *D06F 34/32* (2020.02);
(Continued)

(58) Field of Classification Search
CPC ..... D06F 58/34; D06F 2103/00
(Continued)

(56) References Cited

U.S. PATENT DOCUMENTS 2,395,780 A * 2/1946 Devol, Jr. ..... D06F 71/32 38/40
3,122,426 A * 2/1964 Horecky ..... D06F 34/10 361/178
(Continued)

FOREIGN PATENT DOCUMENTS

CN 101469504 A 7/2009
EP 2458076 A1 * 5/2012 ..... D06F 58/28
(Continued)

OTHER PUBLICATIONS

International Search Report and Written Opinion for International Application No. PCT/EP2018/055680, dated Dec. 11, 2018, 13 pages.
(Continued)

*Primary Examiner* — Stephen M Gravini
(74) *Attorney, Agent, or Firm* — RatnerPrestia

(57) ABSTRACT

A laundry treatment appliance having a humidity measuring arrangement comprising a sensing unit for sensing an electric parameter associated with a laundry load housed in a laundry treatment chamber, a processing unit for determining the humidity of the laundry load according to the sensed electric parameter, and a conductive element electrically coupled to the processing unit and arranged such that, when an at least partially conductive body is in proximity of the conductive element, an electric signal is generated by capacity coupling between the conductive element and the least partially conductive body, wherein the processing unit is configured to access a presence or absence of a user near the appliance according to a pattern of the electric signal at the processing unit.

15 Claims, 6 Drawing Sheets

(51) Int. Cl.

| | |
|---|---|
| ***D06F 103/00*** | (2020.01) |
| ***D06F 105/00*** | (2020.01) |
| ***D06F 105/56*** | (2020.01) |
| ***D06F 105/58*** | (2020.01) |
| ***D06F 105/60*** | (2020.01) |
| ***D06F 34/14*** | (2020.01) |
| ***D06F 34/18*** | (2020.01) |
| ***D06F 34/32*** | (2020.01) |

(52) U.S. Cl.
CPC ..... *D06F 2103/00* (2020.02); *D06F 2103/10* (2020.02); *D06F 2105/00* (2020.02); *D06F 2105/56* (2020.02); *D06F 2105/58* (2020.02); *D06F 2105/60* (2020.02)

(58) Field of Classification Search
USPC ..... 34/282, 595–610
See application file for complete search history.

(56) References Cited

U.S. PATENT DOCUMENTS

| | | | | |
|---|---|---|---|---|
| 4,268,247 | A * | 5/1981 | Freze | D06F 58/26 432/105 |
| 5,187,879 | A * | 2/1993 | Holst | D06F 58/266 34/261 |
| 5,651,192 | A * | 7/1997 | Horwitz | D06F 58/30 236/78 D |
| 6,079,121 | A * | 6/2000 | Khadkikar | G05D 22/02 34/531 |
| 6,784,673 | B2 * | 8/2004 | Tomasi | D06F 58/04 324/664 |
| 7,337,085 | B2 | 2/2008 | Soss | |
| 8,040,142 | B1 | 10/2011 | Bokma et al. | |
| 8,248,084 | B2 | 8/2012 | Bokma et al. | |
| 8,294,687 | B1 | 10/2012 | Ksondzyk | |
| 8,482,536 | B1 | 7/2013 | Young | |
| 8,766,931 | B2 | 7/2014 | Westhues et al. | |
| 8,766,944 | B2 | 7/2014 | Ksondzyk | |
| 8,823,678 | B2 | 9/2014 | Li et al. | |
| 8,866,778 | B2 | 10/2014 | Wu et al. | |
| 8,947,373 | B2 | 2/2015 | Kremin et al. | |
| 8,988,388 | B2 | 3/2015 | Hsueh et al. | |
| 9,001,072 | B2 | 4/2015 | Sobel et al. | |
| 9,013,437 | B2 | 4/2015 | Westerman et al. | |
| 9,024,912 | B2 | 5/2015 | Atkinson et al. | |
| 9,058,078 | B2 | 6/2015 | Weaver et al. | |
| 9,081,450 | B1 | 7/2015 | Mohindra | |
| 9,128,570 | B2 | 9/2015 | Vallis et al. | |
| 9,134,857 | B2 | 9/2015 | Park et al. | |
| 9,164,605 | B1 | 10/2015 | Pirogov et al. | |
| 9,209,802 | B1 | 12/2015 | Maharyta et al. | |
| 9,229,576 | B2 | 1/2016 | Ng et al. | |
| 9,229,577 | B2 | 1/2016 | Kremin et al. | |
| 9,280,243 | B2 | 3/2016 | Huang et al. | |
| 9,310,919 | B2 | 4/2016 | Gowreesunker | |
| 9,372,581 | B2 | 6/2016 | Cattivelli et al. | |
| 9,411,755 | B2 | 8/2016 | Ravirala et al. | |
| 9,417,730 | B2 | 8/2016 | Shin | |
| 9,444,452 | B2 | 9/2016 | Ksondzyk et al. | |
| 9,494,627 | B1 | 11/2016 | Bokma et al. | |
| 9,569,032 | B2 | 2/2017 | Westhues et al. | |
| 9,624,619 | B2 * | 4/2017 | Altinier | D06F 58/38 |
| 9,811,220 | B2 | 11/2017 | Povalac et al. | |
| 9,822,479 | B2 * | 11/2017 | Bae | D06F 58/04 |
| 9,841,840 | B2 | 12/2017 | Vallis et al. | |
| 9,921,668 | B1 | 3/2018 | Chadda et al. | |
| 9,927,924 | B2 | 3/2018 | Staton | |
| 10,031,618 | B2 | 7/2018 | Mohindra | |
| 10,126,889 | B2 | 11/2018 | Westhues et al. | |
| 10,152,208 | B2 | 12/2018 | Wells et al. | |
| 10,394,393 | B2 | 8/2019 | Ramakrishnan et al. | |
| 10,488,985 | B2 | 11/2019 | Lee et al. | |
| 10,676,859 | B2 * | 6/2020 | Vitali | D06F 58/38 |
| 11,248,334 | B2 * | 2/2022 | Vitali | D06F 58/38 |
| 2018/0088786 | A1 | 3/2018 | Abzarian et al. | |
| 2018/0181245 | A1 | 6/2018 | Beck et al. | |
| 2019/0102031 | A1 | 4/2019 | Shutzberg et al. | |
| 2020/0370222 | A1 * | 11/2020 | Bodine | D06F 37/266 |
| 2021/0017694 | A1 * | 1/2021 | Taylor | D06F 58/04 |
| 2021/0071347 | A1 * | 3/2021 | Pattarello | D06F 58/34 |
| 2021/0246602 | A1 * | 8/2021 | Miranda Razo | D06F 58/203 |
| 2021/0372032 | A1 * | 12/2021 | Yoon | D06F 58/02 |
| 2021/0381149 | A1 * | 12/2021 | Park | D06F 58/34 |
| 2022/0042231 | A1 * | 2/2022 | Jang | G06V 40/20 |

FOREIGN PATENT DOCUMENTS

| | | | | |
|---|---|---|---|---|
| EP | 2896736 | A1 | 7/2015 | |
| EP | 3162952 | A1 | 5/2017 | |
| EP | 3162952 | B1 * | 4/2019 | D06F 25/00 |
| JP | 2011196641 | A | 10/2011 | |
| KR | 20150063817 | A * | 6/2015 | |
| KR | 20190104949 | A * | 9/2019 | |
| WO | 2010121949 | A1 | 10/2010 | |
| WO | WO-2015084006 | A1 * | 6/2015 | D06F 58/04 |
| WO | WO-2017072016 | A1 * | 5/2017 | D06F 25/00 |
| WO | WO-2019170232 | A1 * | 9/2019 | D06F 58/30 |

OTHER PUBLICATIONS

Zong et al., "Digital Signal Processing", Tsinghua University Press, 1988 with translation, 8 pages.
Chinese Office Action for Chinese Application No. 201880090626.2, dated Jun. 27, 2022 with translation, 16 pages.

* cited by examiner

LAUNDRY APPLIANCE WITH USER SENSING FUNCTIONALITY

This application is a U.S. National Phase application of PCT International Application No. PCT/EP2018/055680, filed Mar. 7, 2018, which is incorporated by reference herein.

FIELD OF THE INVENTION

The present invention generally relates to the field of laundry treatment appliances (hereinafter, shortly, "laundry appliances"), and particularly to appliances for treating, e.g. drying, items (such as linen, clothes, garments, shoes, and the like), such as laundry drying appliances (comprising laundry dryers or laundry washing machines also implementing laundry drying functions, also referred to as combined laundry washers and dryers). More particularly, the present invention relates to a laundry appliance configured to assess a presence or absence of a user near it and to be controlled according to the assessed presence or absence of the user near it.

BACKGROUND OF THE INVENTION

Most of laundry appliances currently on the market are generally equipped with a number of apparatuses and functionalities aimed at ensuring that a user is correctly and continuously informed about an ongoing treatment process (for example, a laundry drying cycle).

For example, most of laundry appliances may comprise display units for displaying information to the user (such as information about a current phase of the ongoing treatment process, information about a residual time to the end of the ongoing treatment process, information about a current use mode of the laundry appliance, information for function setting, and/or information about errors or maintenance suggestions for one or more components of the laundry appliance), one or more light output devices for emitting a light indicative of the treatment process or for attracting the attention of the user towards a part of the laundry appliance (such as an illumination system for illuminating a laundry treatment chamber of the laundry appliance), one or more sound output devices for emitting a sound indicative of the treatment process, and/or one or more connection devices for allowing a data exchange between the laundry appliance and a remote unit.

Handling or controlling these functionalities and apparatuses (or at least subsets thereof) concurrently during the execution of the treatment process may be burdensome for the laundry appliance, both in terms of computational efforts and in terms of energy requirements.

It would therefore be desirable that the above functionalities and apparatuses (or at least subsets thereof) are enabled only when actually needed.

The Applicant is aware of the presence in the prior art of laundry appliances having some capabilities of determining a presence or absence of the user near it (hereinafter, user presence/absence functionality) and to control some functionalities or apparatuses of the laundry appliance accordingly.

For example, EP2896736 discloses an electric home appliance including a sensing unit for sensing whether a human body is within a predetermined range and recognizing a distance value from the human body, an output unit for outputting information, and a controller for deciding an information output mode of the output unit based on a distance range, within which the distance value from the human body is, among a plurality of predetermined distance ranges in a case in which the human body is sensed.

SUMMARY OF INVENTION

The Applicant has realized that the known solutions are not satisfactory.

Indeed, the Applicant has understood that the known solutions, such as the one disclosed in EP2896736, require dedicated and expensive hardware components, and hence dedicated and expensive circuit arrangements. This implies that the resulting laundry appliances have to be specifically designed to accommodate the dedicated hardware components and circuit arrangements in order to implement the user presence/absence functionality. Otherwise stated, the Applicant has understood that the known solutions implementing the user presence/absence functionality cannot be applied to any existing laundry appliance without a complete (or at least a significant) redesign thereof, and hence without incurring dramatic cost increases.

Last but not least, the dedicated hardware components may also involve additional space occupation, which might translate in increased sizes of the laundry appliances that the users may not likely to appreciate.

In view of the above, it is an object of the present invention to provide a laundry appliance able to overcome these, as well as other, drawbacks, and particularly it is an object of the present invention to provide a laundry appliance implementing the user presence/absence functionality in an easy and cheap manner, and by exploiting most of the components of existing laundry appliances already provided for other purposes.

One or more aspects of the present invention are set out in the independent claims, with advantageous features of the same invention that are indicated in the dependent claims.

An aspect of the present invention relates to a laundry treatment appliance. The laundry treatment appliance comprises a laundry treatment chamber for performing a treatment process on a laundry load housed therein, a control unit for controlling the appliance, and a humidity measuring arrangement for measuring the humidity of the laundry load. The humidity measuring arrangement preferably comprises a sensing unit for sensing an electric parameter associated with the laundry load, and a processing unit for determining the humidity of the laundry load according to the sensed electric parameter. The processing unit is in communication relationship with the sensing unit and with the control unit. The laundry treatment appliance preferably comprises a conductive element electrically coupled to the processing unit; the conductive element is arranged on an appliance part such that, when an at least partially conductive body is in proximity of the conductive element, an electric signal is generated by capacitive coupling between the conductive element and the least partially conductive body and is received by the processing unit. The processing unit is configured to assess a presence or absence of a user near the appliance according to a pattern of the electric signal at the processing unit. The control unit is preferably configured to control the appliance according to the assessed presence or absence of the user near the appliance.

According to an embodiment of the present invention, the processing unit is configured to assess the presence of the user near the appliance if the electric signal at the processing unit is above a predetermined baseline signal level, for example for at least a predetermined time period.

According to an embodiment of the present invention, the control unit is configured to control the appliance with a predetermined control mode when the presence of the user near the appliance is assessed. Preferably, the control unit is further configured to keep controlling the appliance with the predetermined control mode for a predetermined time interval after assessing a passage from presence to absence of the user near the appliance.

According to an embodiment of the present invention, the processing unit is further configured to determine a posture taken by the user near the appliance according to a value of the electric signal. Preferably, the control unit is configured to control the appliance according to the determined posture taken by the user near the appliance.

According to an embodiment of the present invention, said posture taken by the user near the appliance comprises a crouched posture or a standing posture; preferably, in the crouched posture the electric signal takes a first value in a first relationship with a first reference value and in the standing posture the electric signal takes a second value in a second relationship with the first reference value or with a second reference value different from the first reference value.

According to an embodiment of the present invention, at least one between the first and second reference values and the first and second relationships depend on at least one among mass of a human body of the user, height of the human body of the user, expected maximum and minim distances at which the human body of the user is expected to be from the conductive element, and position of the conductive element on the appliance.

According to an embodiment of the present invention, at least one among said mass of the human body of the user, height of the human body of the user, and expected maximum and minimum distances at which the human body of the user is expected to be from the conductive element is settable by the user, for example during a configuration phase of the appliance.

According to an embodiment of the present invention, the conductive element is arranged on a door frame. Preferably, in the first relationship the first value taken by electric signal is higher than the first reference value and in the second relationship the second value taken by the reference signal is between the first reference value and the second reference value, the second reference value being for example lower than the first reference value.

According to an embodiment of the present invention, the appliance comprises at least one among a display unit for displaying information to the user, a light output device for emitting a light indicative of the treatment process or for attracting the attention of the user towards an appliance part, a sound output device for emitting a sound indicative of the treatment process, and a connection device for allowing a data exchange between the appliance and a remote unit. The control unit is advantageously configured to control the appliance by controlling at least one among:

- a turning on or a turning off of the display unit, of the light output device and of the sound output device;
- a type of information displayed by the display unit, when the display unit is turned on;
- an intensity of the light emitted by the light output device;
- a volume of the sound emitted by the sound output device;
- a turning on or a turning off of the connection device, and/or an enabling or disabling of said data exchange between the appliance and the remote unit when the connection device is turned on.

According to an embodiment of the present invention, the type of information comprises at least one among:

- information about a current phase of the ongoing treatment process;
- information about a residual time to the end of the ongoing treatment process;
- information about a current use mode of the laundry appliance;
- information for function setting, and
- information about errors or maintenance suggestions for one or more appliance components.

According to an embodiment of the present invention, the light output device comprises an illumination system for illuminating the laundry treatment chamber. The control unit is advantageously configured to turn on the illumination system when the determined posture taken by the user near the appliance is the crouched posture.

According to an embodiment of the present invention, the conductive element is electrically coupled to the processing unit by means of a conductive coupling.

According to an embodiment of the present invention, the conductive element is electrically coupled to the processing unit by means of a capacitive coupling.

According to an embodiment of the present invention, the laundry appliance comprises a cabinet accommodating the laundry treatment chamber. The cabinet preferably comprises a front structure provided with a loading opening for accessing the laundry treatment chamber. The processing unit is advantageously mounted to the front structure at the loading opening.

According to an embodiment of the present invention, the sensing unit comprises a first electric conductor of a humidity sensing capacitor and a second electric conductor of the humidity sensing capacitor, the laundry load advantageously acting as a dielectric of the humidity sensing capacitor.

BRIEF DESCRIPTION OF THE ANNEXED DRAWINGS

These and other features and advantages of the present invention will be made apparent by the following description of some exemplary and non-limitative embodiments thereof; for its better intelligibility, the following description should be read making reference to the attached drawings, wherein.

Figure 4:
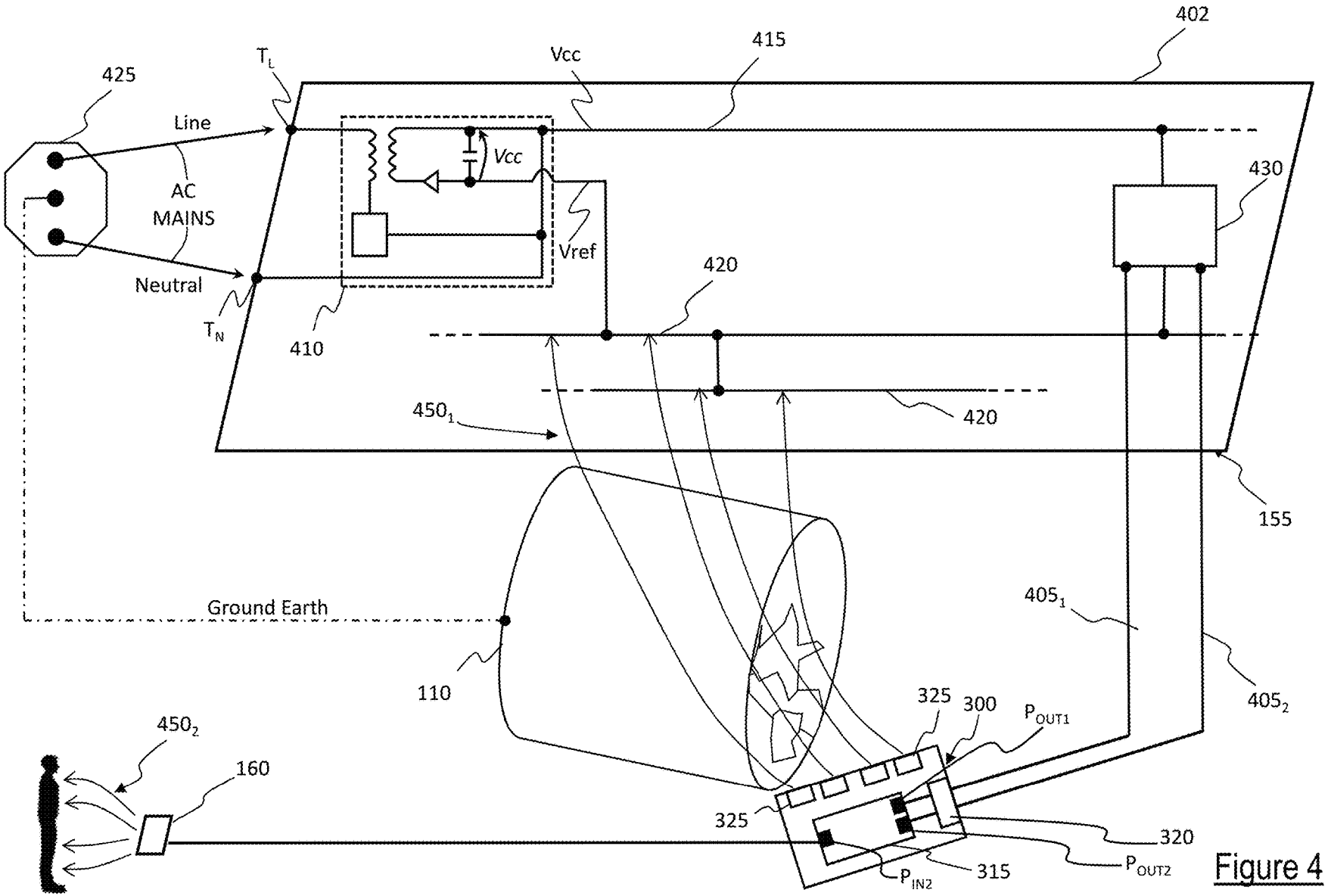
Figure 5B:
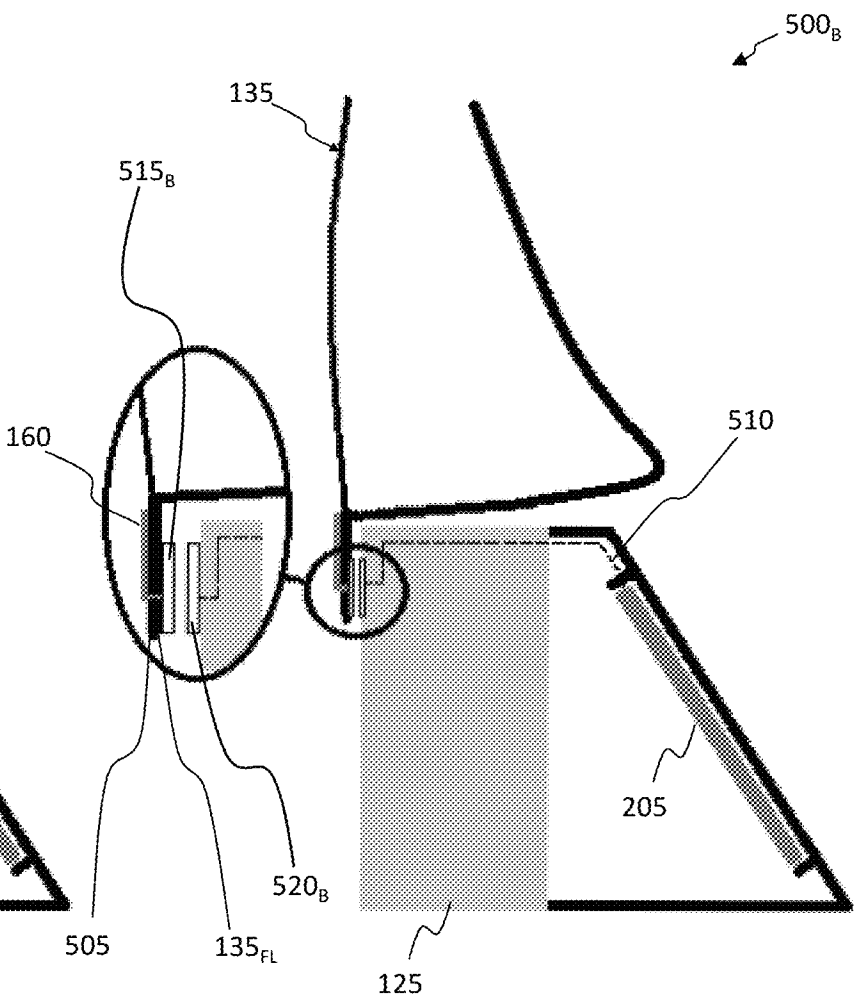
Figure 5A:
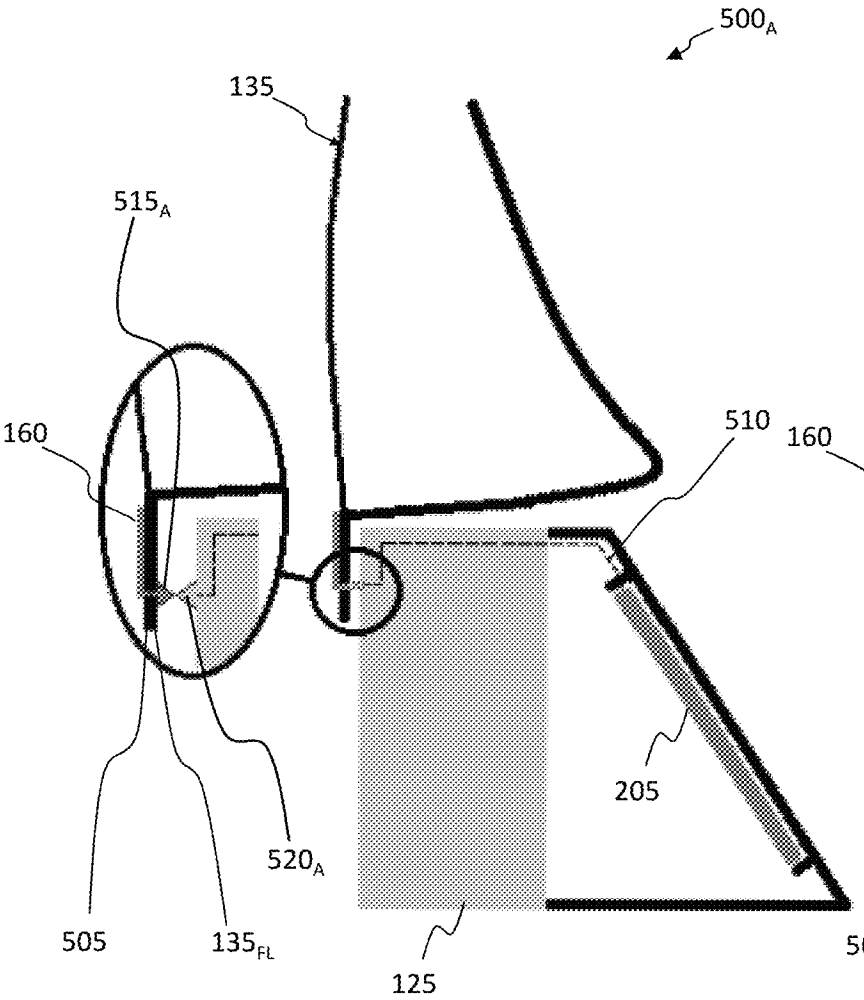
Figure 6:
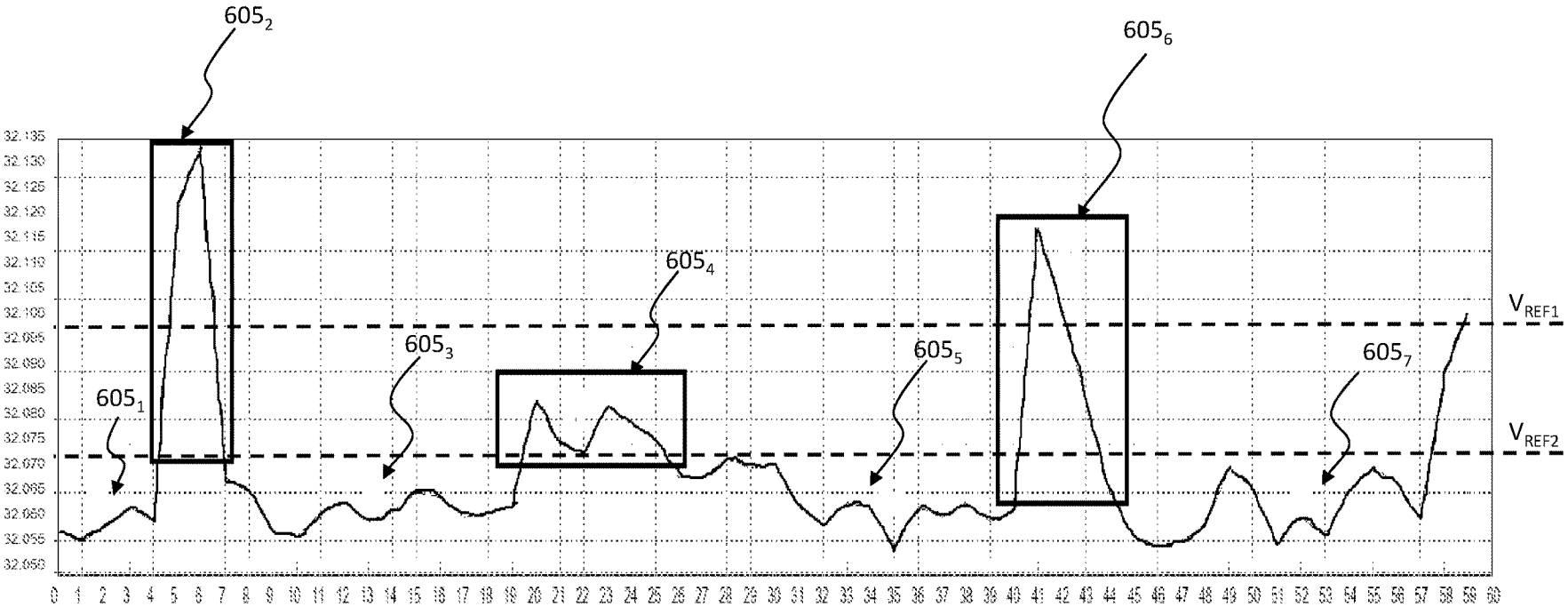

FIG. 4 schematically shows, partly in terms of functional blocks, the humidity measuring arrangement and the user sensing arrangement, according to an embodiment of the present invention;

FIGS. 5A and 5B schematically show the user sensing arrangement according to respective embodiments of the present invention, and FIG. 6 shows an electric signal generated by capacitive coupling between a conductive element of the laundry appliance and an at least partially conductive body near it, according to an embodiment of the present invention.

DETAILED DESCRIPTION OF PREFERRED EMBODIMENTS OF THE INVENTION

Figure 1:
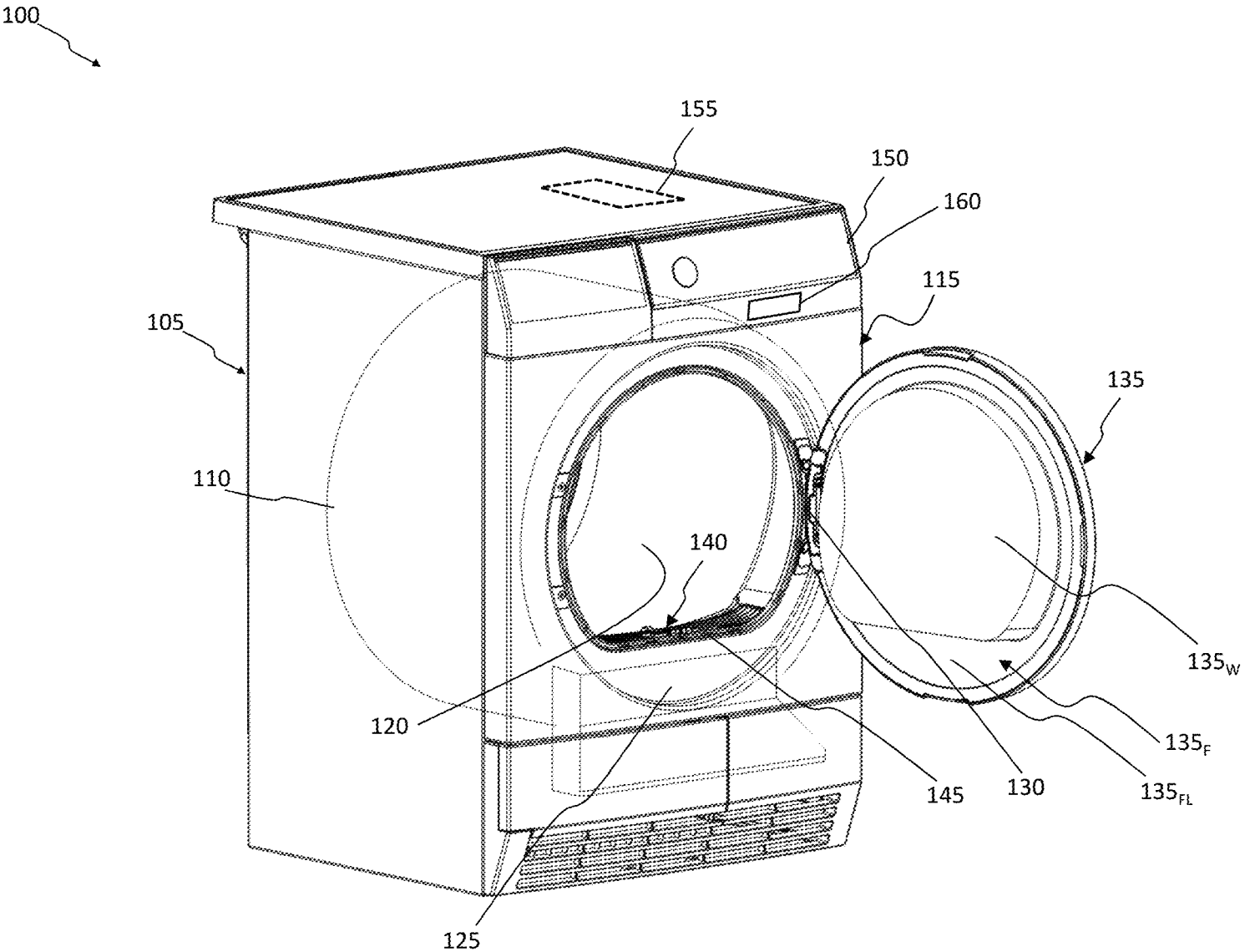
FIG. 1 is a perspective view of a laundry appliance according to an embodiment of the present invention.

With reference to the drawings, FIG. 1 shows a perspective view of a laundry appliance 100 according to an embodiment of the present invention. According to the exemplary, not limiting, embodiment herein considered, the laundry appliance 100 is a laundry dryer, such as a tumble drier. In any case, although in the following description explicit reference will be made to a laundry dryer, this should not to be construed as a limitation; indeed, the present invention applies to other types of laundry appliances (for example combined washers/dryers, i.e. washing machines also having laundry drying functions).

The laundry appliance 100 comprises a (e.g., parallepiped-shaped) cabinet 105, which preferably accommodates a treatment chamber (i.e., a laundry drying chamber in the example herein considered of a laundry dryer) for performing a treatment process on items housed therein (i.e., a drying process on a laundry load in the example herein considered of a laundry dryer).

The laundry drying chamber is for example defined by the inner space of a, preferably rotatable, drum 110 which is adapted to contain the laundry load to be dried (in a combined washer/dryer, the laundry treatment chamber may instead comprise a washing basket or drum which is contained in a washing tub).

Preferably, the cabinet 105 also encloses electrical/electronic/mechanical, and hydraulic components for the operation of the laundry appliance 100 (such as for example motor, electromechanical valves, pumps and impellers of the hydraulic apparatus, one or more heating elements for heating water/washing liquids/air), not shown.

A bottom portion of the cabinet 105 that, in use, faces the floor preferably comprises one or more supporting pins or feet (not shown), preferably vertically adjustable supporting feet, to improve the contact with the floor and adjusting the position of the cabinet 105 relative to the floor.

A front structure 115 of the cabinet 105 has a loading opening 120 providing an access to the drum 110 for loading/unloading the laundry load to be dried. Preferably, the loading opening 120 has a rim 125, preferably substantially annular in shape, in which door hinges 130 as well as door locking means (not shown) are arranged for, respectively, hinging and locking a door 135. The door 135 is adapted for sealably closing the loading opening 120 during the operation of the laundry appliance 100. The door 135 preferably comprises a (e.g. plastic) door frame $\mathbf{135}_F$ surrounding a transparent circular glass porthole window $\mathbf{135}_W$, which allows a user to see the interior of the laundry appliance 100 during the operation thereof, so as to visually check a correct operation of the ongoing treatment process set by the user. Preferably, the glass porthole window $\mathbf{135}_W$ is substantially bowl-like in shape (exception made for a rectilinear side), i.e. it extends inwards towards the drum 110 when the door 135 is closed (so as to avoid or cover dead spaces between the cabinet 105 and the drum 110), whereas the door frame $\mathbf{135}_F$ is substantially annular in shape, exception made for a lower portion $\mathbf{135}_{FL}$ thereof that is circular-segment in shape due to the presence of the rectilinear side of the glass porthole window $\mathbf{135}_W$. The door 135 is adapted for sealably closing the loading opening 120 by abutment of the door frame $\mathbf{135}_F$ on the rim 125 when the door 135 is in the closed position.

A power cord (not shown in the drawings), preferably provided with a plug, exits from a rear side of the cabinet 105 (also not shown) opposite the front structure 115, and serves for powering the laundry appliance 100 when connected to the power mains.

Preferably, the drum 110 is rotatably supported on one or more rollers. Preferably the drum 110 is rotatably supported on a cabinet portion and/or a (e.g., plastic) basement (not shown) of the laundry appliance 100, the basement being for example adapted to accommodate a moisture condensing element and/or a drying air heating device. More preferably, the drum 110 is rotatably supported on a basement and/or on a cabinet portion by means of rollers (also not shown) mounted thereon. The rollers are preferably mounted on the basement by means of respective bushings or pins (not shown) provided on the basement, each pin being for example supported by a respective bracket (not shown) in the plastic basement.

The laundry appliance 100 preferably comprises a drying air circuit for causing drying air to circulate through the drum 110 where the laundry load to be dried is housed. The drying air circuit is not shown in the drawings, it being not relevant for the understanding of the present invention. Without losing generality, the drying air circuit may for example be an open-loop drying air circuit (wherein the drying air is: taken in from the outside ambient, heated up, caused to flow through the drum 110 to extract moisture from the laundry to be dried, then possibly de-moisturized and cooled down and finally exhausted to the outside ambient), or a closed-loop drying air circuit (wherein the drying air is: heated up, caused to flow through the drum 110 to extract moisture from the laundry to be dried, de-moisturized and cooled down, and then again heated up and reintroduced in the drum). The drying air circuit for de-moisturizing, cooling and condensing may comprise an air-air heat exchanger or a heat pump exploiting a suitable refrigerant fluid. The drying air heater may comprise a Joule-effect heater; in case of use of a heat pump, one of the heat exchangers of the heat pump is used to cool down the moisture-laden drying air, whereas another heat exchanger of the heat pump may advantageously be exploited for heating the drying air.

The drying air circuit is for example designed such that the drying air is introduced into the drum 110 at or proximate to a rear portion thereof (rear with respect to the laundry appliance front, corresponding to the front structure 115). After flowing through the drum 110 (and hitting the laundry load contained therein), the drying air can leave the drum 110 passing through an air-opening 140 provided close to the rim 125 of the loading opening 120, on the inner side thereof (i.e., looking the laundry appliance frontally, behind the rim 125 of the loading opening 120). The air-opening 140 advantageously comprises a filter seat for housing a fluff filter 145 provided with filtering surfaces adapted to allow the passage of air but to impede the passage of fluff lost by the items being dried and tumbled in the drum 110 during the drying operations.

In addition, a user interface 150 may be advantageously provided, preferably but not limitatively, on the front structure 115. Preferably, the user interface 150 comprises a display unit (for example, a light emitting polymer display (LPD), or a liquid crystal display, or a thin film transistor-liquid crystal display, or an organic light-emitting diode display, not shown) for visually displaying information, and one or more selection buttons and/or knobs (not shown) for allowing a user to select laundry treatment processes (e.g., a set of operations and control parameters designed for treating peculiar fabrics, such as wool items) to be carried out by the laundry appliance 100. More preferably, the user interface 150 also comprises one or more setting buttons for allowing the user to set and/or adjust and/or calibrate user parameters of a user sensing functionality of the laundry appliance 100 for (e.g., capacitively) sensing the presence (or absence) of the user near it, as discussed below.

Although not shown, the laundry appliance 100 may comprise one or more additional electrical/electronic/electromechanical components; examples of these additional electrical/electronic/electromechanical components are, but are not limited to, one or more light output devices for emitting a light indicative of the treatment process (such as notification lights, for example notification LEDs) and/or one or more light output devices for attracting the attention of the user towards a part of the laundry appliance 100 (for example, a drum illumination system for illuminating the drum 110), one or more sound output devices for emitting sounds indicative of the treatment process, and a connection device (for example, a network interface controller or network adapter) for allowing a (e.g., wired or wireless) data exchange between the laundry appliance 100 and a remote unit (for example, a user mobile terminal or a manufacturer server). These additional electrical/electronic/electromechanical components may be located at any suitable, not limiting, position of the laundry appliance 100.

Preferably, the laundry appliance 100 is further provided with a control unit 155 for controlling the laundry appliance 100 (the control unit 155 being schematically illustrated as a dashed rectangle in FIG. 1) according to instructions received by a user through the user interface 150. As visible in the figure, the control unit 155 is preferably placed in a top position inside the casing, so as to be less prone to contacts with liquids or humidity possibly leaking from the drum 110.

For example, the control unit 155 provides power and interacts with the electrical/electronic/electromechanical components in order to manage the execution of selected laundry-treating operations, and with the display unit and the additional electrical/electronic/electromechanical components.

As better discussed in the following, the control unit 155 is also configured to control the laundry appliance 100 (and particularly, although not exclusively, the display unit and the additional electrical/electronic/electromechanical components) according to the presence or absence of the user near it.

The laundry appliance 100 is preferably equipped with a humidity measuring arrangement for measuring the humidity degree of the laundry load to be dried, which could be used to provide drying information including an estimation of a mass of the load, and/or an estimation of a residual humidity of the load, and/or an estimation of a residual time to the end of the drying cycle, and/or a detection of an end of the drying cycle. For the purposes of the present disclosure, the humidity measuring arrangement comprises a sensing unit for sensing an electric parameter associated with the laundry load, and a processing unit, in communication relationship with the sensing unit and with the control unit 155, for determining the humidity of the laundry load according to the sensed electric parameter (aspects, components and functionalities of a basic implementation of the humidity measuring arrangement deemed relevant for the understanding of the present invention will be briefly discussed in the following).

According to the principles of the present invention, a conductive element 160 electrically coupled to the processing unit (i.e., the processing unit that is already in charge of determining the humidity of the laundry load according to the sensed electric parameter) is arranged on the front structure 115 of the laundry appliance 100 (preferably, being exposed from it) such that, when an at least partially conductive body (such as the human body of the user) is in proximity of the conductive element 160, an electric signal is generated by capacitive coupling between the conductive element 160 and the at least partially conductive body and is received by the processing unit—the position of the conductive element 160 on the front structure 115 of the laundry appliance 100 shown in FIG. 1 is merely arbitrary, as will be understood from the following discussion. In its turn, the processing unit is configured to assess the presence or absence of the user near the laundry appliance 100 according to a pattern (i.e. trend) of the electric signal at the processing unit, and the control unit 155 is configured to control the laundry appliance 100 according to the assessed presence or absence of the user near it.

In other words, the conductive element 160 and any at least partially conductive body (such as the human body of the user) act, respectively, as first and second electric conductors of a user sensing capacitor of a user sensing arrangement implementing the user sensing functionality, with the air between the conductive element and the at least partially conductive body that acts as a dielectric of the user sensing capacitor. The user sensing arrangement so obtained (and including at least the user sensing capacitor and the processing unit) shares with the humidity measuring arrangement at least one component (i.e., at least the processing unit). This avoids the need of dedicated and expensive hardware components, and hence of dedicated and expensive circuit arrangements (the conductive element 160 is a very simple component, and together with the respective electrical connections adds substantially no contribution in terms of architectural complexity, costs and size).

According to an embodiment of the present invention, which will be considered and discussed in the following by way of example only, the sensing unit of the humidity sensing arrangement is an electronic humidity sensing capacitor (i.e. the electric parameter sensed by the sensing unit comprises capacitance and/or capacitance variations associated with humidity of, and/or humidity changes in, the laundry load to be dried contained in the rotating drum 110); preferably, the humidity sensing capacitor comprises two electric conductors spaced apart from each other, with the laundry load between the electric conductors that acts as a dielectric of the humidity sensing capacitor.

Figure 2:
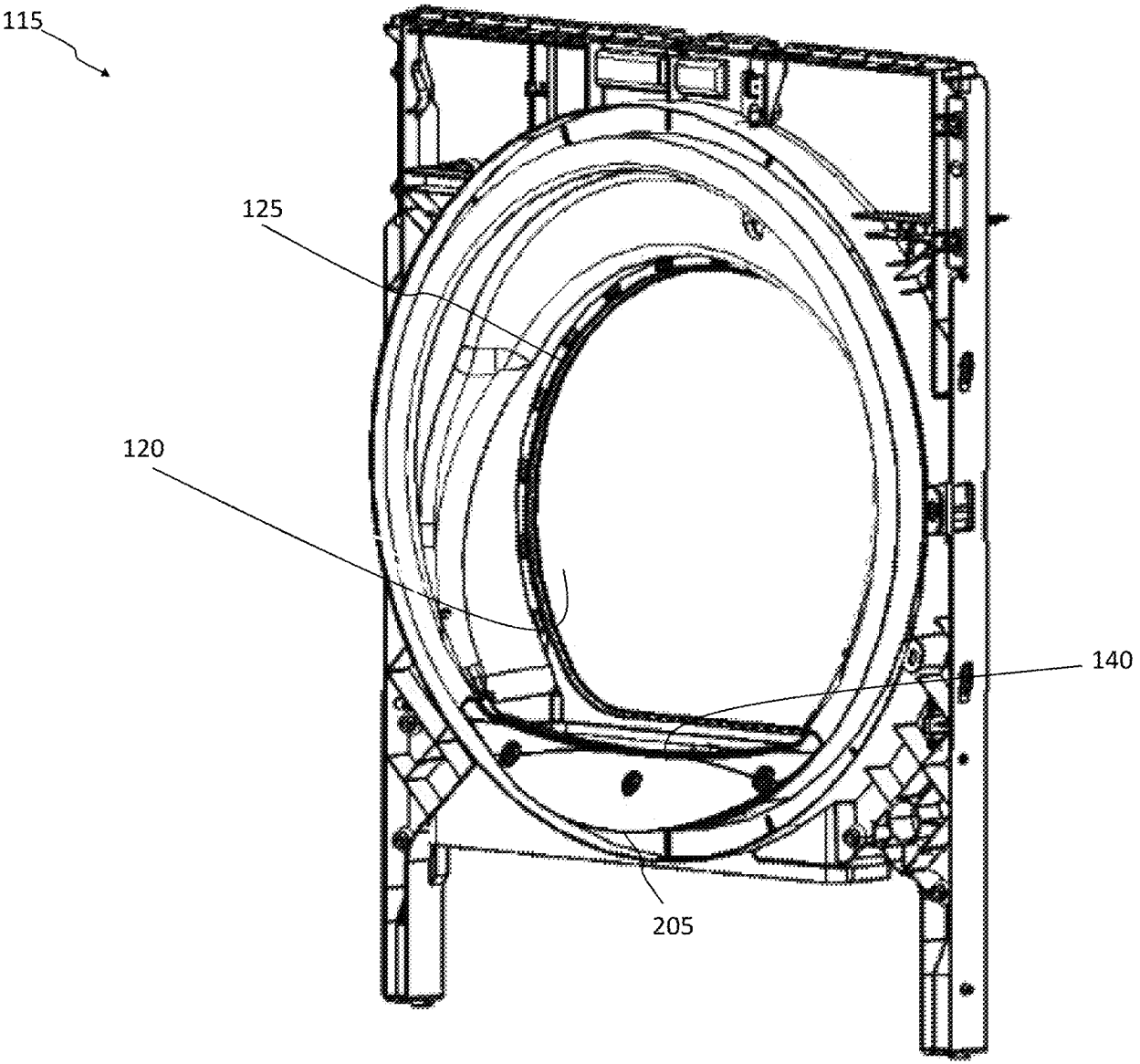
FIG. 2 is a perspective view, from behind, of a front structure of the laundry appliance according to an embodiment of the present invention.

FIG. 2 is a view of the front structure 115 from behind, showing the inner side of the loading opening rim 125, facing towards the drum 110; in FIG. 2, the front structure 115 is shown dismounted from the rest of the cabinet 105 and the fluff filter 145 has been removed from the corresponding filter seat, leaving the air-opening 140 free.

A cover member, e.g. a cover plate 205, is preferably mounted on the inner side of the front structure 115, just below the rim 125 of the loading opening 120 in the illustrated example. In operation, the cover plate 205 faces the drum 110 and is in front of the laundry load to be dried that, while tumbling inside the drum 110, falls by gravity to the bottom of the drum 110. Preferably, the cover plate 205 is made of a dielectric material, the cover plate 205 being for example made of a plastic material. In the example of FIG. 2, the cover plate 205 is shaped substantially as a circular segment, e.g. resembling a stylized "smile" in plan-view.

According to the present invention, the cover plate 205 is arranged for housing in a substantially watertight manner at least part of the humidity measuring arrangement, and at least part of the user sensing arrangement.

Figure 3:
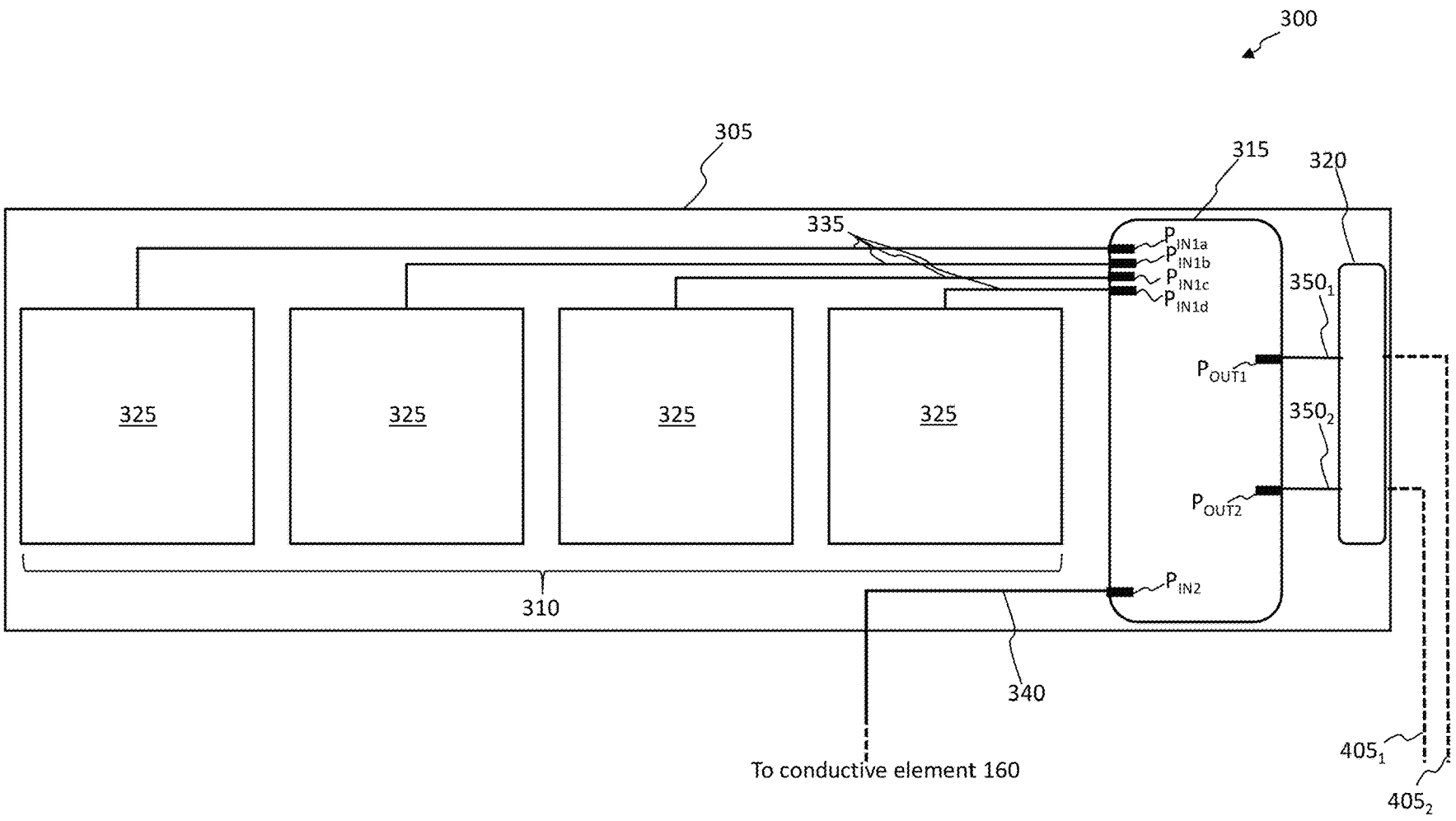
FIG. 3 shows parts of a humidity measuring arrangement and of a user sensing arrangement housed in a cover plate of the laundry appliance, according to an embodiment of the present invention.

The (relevant) parts of the humidity measuring arrangement and of the user sensing arrangement housed in the cover plate 205 are shown in FIG. 3, and will be globally referred to also as arrangement 300.

According to the exemplary considered embodiment of the present invention, the sensing unit of the humidity measuring arrangement (i.e., humidity sensing capacitor in the example at issue) comprises, within the cover plate 205, an operating support, such as an electronic board 305 (e.g., a Printed Circuit Board, or PCB) on which a sensing arrangement 310 (which, in the considered embodiment, is part of the humidity sensing capacitor), the processing unit 315 (comprising, for example, one or more electronic components—such as microprocessors, microcontrollers, "Application-Specific Integrated Circuits" (ASICs), "Digital Signal Processors" (DSPs), memory elements—arranged for filtering, amplifying and digitalizing, and/or otherwise manipulating electric, analogic signals), and a connector interface 320 (e.g., a connector device manufactured according to the Surface Mounting Technology on the electronic board 305) are provided.

Preferably, the sensing arrangement 310 comprises one or more pads 325 (four in the illustrated example) provided on the electronic board 305 (preferably, on an operative surface thereof), the pads 325 being for example made in an electrically conductive material (such as for example aluminum or copper). According to an embodiment of the present invention, each pad 325 is made by using a respective metal layer of the electronic board 305 (e.g., in case of a PCB). Advantageously, metal layers provided on the operative surface of the electronic board 305 (mainly provided for implementing conductive tracks intended to couple electronic components arranged on the electronic board 305) are (e.g., chemically and/or mechanically) etched in order to define the pads 325.

Each pad 325 is electrically connected to the processing unit 315 for providing to the processing unit 315 the electric parameter sensed by the humidity sensing capacitor (i.e., capacitance and/or capacitance variations associated with humidity of the laundry load). For example, each pad 325 is electrically connected to the processing unit 315 (preferably, to a respective input pin $P_{IN1a}$-$P_{IN1d}$ thereof) by means of a respective conductive track 335 provided on the operative surface of the electronic board 305.

The conductive element 160 (not shown in this figure) is electrically connected to the processing unit 315 for providing to the processing unit 315 the electric signal generated by capacitive coupling between the conductive element 160 and any at least partially conductive body (such as the human body of the user). For example, the conductive element 160 is electrically connected to the processing unit 315 (preferably, to one or more input pins thereof, such as the input pin $P_{IN2}$) by means of a respective (e.g., dedicated) conductive track 340.

The processing unit 315 is further electrically connected to the connector interface 320 by means of one or more conductive tracks. Preferably, one or more output pins (such as the output pin $P_{OUT1}$) of the processing unit 315 are electrically connected to the connector interface 320 by means of one or more conductive tracks (such as the conductive track $\mathbf{350}_1$) for providing to the connector interface 320 (and, hence, to the control unit 155) data (hereinafter, humidity data) indicative of the humidity of the laundry load as determined by the processing unit 315 based on the sensed electric parameter, and one or more output pins (such as the output pin $P_{OUT2}$) of the processing unit 315 are electrically connected to the connector interface 320 by means of one or more conductive tracks (such as the conductive track $\mathbf{350}_2$) for providing to the connector interface 320 (and, hence, to the control unit 155) data (hereinafter, user presence/absence data) indicative of the presence or absence of the user near the laundry appliance 100 as determined by the processing unit 315 based on the pattern of the electric signal generated by capacitive coupling between the conductive element 160 and any at least partially conductive body.

The connector interface 320 is preferably adapted to electrically and, preferably, mechanically couple with one or more wirings (denoted by the number references $\mathbf{405}_1$,$\mathbf{405}_2$ in FIG. 4, and depicted also in FIG. 3 by dashed lines for the sake of completeness) for operatively coupling the arrangement 300 to the control unit 155 of the laundry appliance 100. In the illustrated embodiment, the wirings $\mathbf{405}_1$,$\mathbf{405}_2$ allow operatively coupling the output pins $P_{OUT1}$, $P_{OUT2}$ of the processing unit 315 to the control unit 155, so as to provide to the control unit 155 the humidity data and the user presence/absence data. Advantageously, the control unit 155 is also configured to supply electric power to the arrangement 300 through the wiring $\mathbf{405}_1$ and/or the wiring $\mathbf{405}_2$.

With reference also to FIG. 4, it schematically shows, partly in terms of functional blocks, the humidity measuring arrangement and the user sensing arrangement, according to an embodiment of the present invention;

In this figure, the number reference 402 denotes an electronic board, such as for example a "Printed Circuit Board" (PCB), or a plurality (system) of PCBs, belonging to the control unit 155 of the laundry appliance 100, shown schematically and with only a few of the (several other) electronic/electromechanical components actually present in the laundry appliance 100.

A DC (Direct Current) power supply generation circuit 410 generates the DC electric potentials for supplying the electronics. For example, the DC power supply generation circuit 410 generates two DC electric potentials Vcc and Vref, where the value of the electric potential Vcc, being the supply voltage for the electronics, is equal to the value of the electric potential Vref, being the reference voltage for the electronics, plus a nominally constant value Vcc which is typically 5V, or 3.3V, or less, depending on the families of Integrated Circuits to be power supplied. The two DC electric potentials Vcc and Vref are distributed, i.e. routed, through the PCB (or plurality of PCBs) 402 by means of a system of conductive tracks, comprising conductive tracks 415 for routing the electric potential (supply voltage) Vcc, and conductive tracks 420 for routing the electric potential (reference voltage) Vref, so as to be brought to the locations, on the PCB 402, where electronic components are placed. In alternative embodiments, conductive wires may replace the conductive tracks 415 and/or the conductive tracks 420.

The DC power supply generation circuit 410 generates the two DC electric potentials Vcc and Vref starting from an AC voltage (e.g., 230 V @ 50 Hz, or 110 V @ 60 Hz) supplied by an AC power distribution network to the premises of the users. Electric terminals $T_L$ and $T_N$ on the PCB 402 receive a line AC voltage Line and a neutral AC voltage Neutral when the laundry appliance 100 is plugged to an AC main socket 425. The DC power supply generation circuit 410 preferably comprises transformers, capacitors, rectifiers, and DC voltage regulators. The AC main socket 425 (and the appliance plug) also has a ground contact providing a ground potential. In order to comply with safety prescriptions imposing that the user must not receive electric shocks in case he/she touches any part of the appliance that can be at the reach of the user body, such appliance parts are kept to the ground potential. It is pointed out that the electric potential (reference voltage) Vref for the electronics is typically not equal to the ground potential. In some embodiments, the laundry appliance 100 could even have no connection to the ground earth potential (Class II machines), this not affecting the implementation of the present invention.

Preferably, as illustrated, the DC electric potentials Vcc (supply voltage) and Vref (reference voltage) are routed and supply DC power to an main control circuitry, schematized as a functional block 430, that governs the appliance operation.

The DC electric potentials Vcc and Vref are routed, and supply DC power is thus fed, to the arrangement 300 through the wirings $\mathbf{405}_1$,$\mathbf{405}_2$. For example, the wirings $\mathbf{405}_1$,$\mathbf{405}_2$ may provide each one a respective one of the DC electric potentials Vcc,Vref to the arrangement 300.

As mentioned above, the wirings $\mathbf{405}_1$,$\mathbf{405}_2$ also allow an exchange of the humidity data and user presence/absence data with the control unit 155, particularly with the main control circuitry 430 thereof.

In this basic implementation, the cover plate 205, the laundry load within the drum 110 and the air act, as a whole, as dielectric of the humidity sensing capacitor, the pads 325 act as first electric conductor of the humidity sensing capacitor, and the reference voltage Vref routed by the conductive tracks 420 acts as (virtual) second electric conductor of the humidity sensing capacitor.

Preferably, the capacitance variations detected by the arrangement 300 (see the thin curves $\mathbf{450}_1$ in FIG. 4 schematizing the electric field lines that start at the pads 325 and end at the conductive tracks 420) are received and analyzed by the processing unit 315 for deriving information about the degree of humidity of the laundry load being dried, and this information about the degree of humidity of the laundry load (i.e., the humidity data) is provided to the main control circuitry 430 for performing one or more among the following, as well as other, operations: estimating (or updating) the residual time to the end of the drying cycle (and, possibly, adapting the on-going drying program on the go), estimating a load mass, determining an end of the drying cycle, estimating the amount of water contained in the laundry load to be dried before starting a drying cycle.

According to the present invention, the electric signal generated by capacitive coupling between the conductive element 160 and any at least partially conductive body (see the thin curves $\mathbf{450}_2$ in FIG. 4 schematizing the electric field lines that start at the conductive element 160 and end at the human body of the user, and resulting in said electric signal) are received and analyzed by the processing unit 315 for deriving information about the presence or absence of the user near the laundry appliance 100, and this information about the presence or absence of the user near the laundry appliance 100 (i.e., the user presence/absence data) is provided to the main control circuitry 430 for controlling the operation of the laundry appliance 100 (as detailed in the following).

With reference now to FIGS. 5A and 5B, they schematically show the user sensing arrangement (without the human body of the user or any other at least partially conductive body) according to respective embodiments of the present invention. Particularly, FIG. 5A shows a user sensing arrangement $\mathbf{500}_A$ in which the conductive element 160 is electrically coupled to the processing unit by means of a conductive coupling, whereas FIG. 5B shows a user sensing arrangement $\mathbf{500}_B$ in which the conductive element 160 is electrically coupled to the processing unit by means of a capacitive coupling. In both figures, the processing unit is not visible, as being enclosed by the cover plate 205 (as discussed above).

In both embodiments of FIGS. 5A and 5B, the coupling between the conductive element and the processing unit takes place based on a coupling between a coupling portion of the conductive element 160 and a coupling portion of the processing unit that couple to each other when the door is in the closed condition.

Preferably, as illustrated, the conductive element 160 is arranged at (i.e., in correspondence of) the door 135, preferably at the door frame $\mathbf{135}_F$, and even more preferably on the lower portion $\mathbf{135}_{FL}$ of the door frame $\mathbf{135}_F$. Still more preferably, as illustrated, the conductive element 160 is arranged on a face (hereinafter, front face) of the lower portion $\mathbf{135}_{FL}$ of the door frame $\mathbf{135}_F$ that faces the human body of the user when the door 135 is in the door condition, whereas the coupling portion of the conductive element 160 is arranged on a face (hereinafter, rear face) of the lower portion $\mathbf{135}_{FL}$ of the door frame $\mathbf{135}_F$ that faces the rim 125 when the door 135 is in the closed condition. As exemplary illustrated, the coupling portion $\mathbf{515}_A$,$\mathbf{515}_B$ of the conductive element 160 may be connected to the conductive element 160 by means of a wire 505 passing in a through hole of the lower portion $\mathbf{135}_{FL}$ of the door frame $\mathbf{135}_F$, the through hole for example extending between (and opening to) the front and rear faces of the lower portion $\mathbf{135}_{FL}$ of the door frame $\mathbf{135}_F$.

Preferably, as illustrated, the coupling portion $\mathbf{520}_A$,$\mathbf{520}_B$ of the processing unit is arranged at the rim 125, the coupling portion of the processing unit being for example connected to the processing unit by means of a wire 510. More preferably, the coupling portion of the processing unit is arranged on a lower portion of the rim 125, and even more preferably on the lower portion of the rim 125 in front of the air-opening 140 and on which the lower portion $\mathbf{135}_{FL}$ of the door frame $\mathbf{135}_F$ abuts when the door 135 is in the closed position.

In the embodiment of FIG. 5A, the coupling between the conductive element 160 and the processing unit is achieved by physical contact (i.e., conductive coupling) between the coupling portion $\mathbf{515}_A$ of the conductive element 160 and the coupling portion $\mathbf{520}_A$ of the processing unit. Preferably, as illustrated in the enlarged detail view of FIG. 5A, the coupling portions $\mathbf{515}_A$,$\mathbf{520}_A$ are in the form of electrically conductive (e.g., metal) contacts that come into contact (thus enabling the user sensing arrangement) when the door 135 is in the closed condition.

In the embodiment of FIG. 5B, the coupling between the conductive element 160 and the processing unit is achieved by capacitive coupling between the coupling portion $\mathbf{515}_B$ of the conductive element 160 and the coupling portion $\mathbf{520}_B$ of the processing unit. Preferably, as illustrated, the coupling portions $\mathbf{515}_B$,$\mathbf{520}_B$ are in the form of electrically conductive (e.g., metal) pads or plates that, when the door 135 is in the closed condition, face to each other at a predetermined distance (thus enabling the capacitive coupling, and hence the operation of user sensing arrangement). Advantageously, at least one of the coupling portions $\mathbf{515}_B$,$\mathbf{520}_B$ also comprises a dielectric layer (not shown) on at least a region thereof that, when the door 135 is in the closed condition, faces the other coupling portion $\mathbf{520}_B$,$\mathbf{515}_B$. This makes the capacitive coupling even more effective.

The capacitive coupling, such as the capacitive coupling of the embodiment of FIG. 5B, is particularly advantageous in making the coupling between the conductive element 160 and the processing unit substantially unaffected by dirt particles. In fact, contrary to the conductive coupling (for example the conductive coupling of the embodiment of FIG. 5A), in which dirt particles (such as fluff) on and between the contacts preclude or at least strongly reduce the electrical conduction, in the capacitive coupling the dirt particles between the contacts essentially add a dielectric contribution (which essentially adds to the dielectric component given by the air and/or by the dielectric layer, when provided).

As mentioned above, according to the principles of the present invention, the processing unit 315 is configured to assess the presence or absence of the user near the laundry appliance 100 according to the pattern of the electric signal generated by capacitive coupling between the conductive element 160 and any at least partially conductive body, and received at the processing unit 315.

An example of electric signal generated by capacitive coupling between the conductive element 160 and at least partially conductive bodies (including the human body of the user), and particularly of an electric signal including a number of embodiments of the user sensing functionality, is shown in FIG. 6. In the following, by values of the electric signal will be meant value ranges of the electric signal; this is consistent with the capacitive nature of the considered electric signal, which unavoidably exhibits fluctuations and oscillations around one or more values rather than taking exactly these values.

According to an embodiment of the present invention, the processing unit 315 is configured to assess the presence of the user near the laundry appliance 100 if the electric signal at the processing unit is above a predetermined baseline level.

The baseline level corresponds, in FIG. 6, to the portions of the electric signal denoted by the number references $\mathbf{605}_1$, $\mathbf{605}_3$, $\mathbf{605}_5$ and $\mathbf{605}_7$). The baseline level is conceptually similar to an electric background noise, and is mainly due to the "interaction" of the conductive element 160 with conductive or at least partially conductive particles naturally suspended in the air even in the absence of human bodies or other at least partially conductive macroscopic bodies.

Preferably, the processing unit 315 is configured to assess the presence of the user near the laundry appliance 100 if the electric signal at the processing unit is above the predetermined baseline level for at least a predetermined time period; in this way, it is possible to exclude that fast and short duration electrical transients or spikes due, for example, to temporary passages near the laundry appliance 100 by the user or other at least partially conductive bodies such as pets or children are wrongly interpreted.

According to a preferred, not limiting, embodiment of the present invention, based on the electric signal, the processing unit 315 is also configured to determine a posture taken by the user near the laundry appliance 100—such that control unit 155 may control the laundry appliance 100 according to the determined posture, as better discussed in the following.

Preferably, the processing unit 315 is configured to determine the posture taken by the user near the laundry appliance 100 based on values of the electric signal when the electric signal is not at the baseline level (i.e., when the electric signal is at a level interpreted as presence of the user near the laundry appliance 100).

Preferably, as herein assumed, the processing unit 315 is able to distinguish between a crouched posture and a standing posture of the user near the laundry appliance 100. More preferably, thanks to its computational capabilities, the processing unit 315 is able to perform a comparison between the values taken by the electric signal and one or more reference values, and to determine whether the user near the laundry appliance 100 is in the crouched posture or in the standing posture according to relationship(s) between the electric signal (i.e., the values thereof) and the reference value(s)—in the following, two reference values will be considered by way of example only.

As should be understood, the specific relationship(s) between the electric signal and the reference values that are interpreted by the processing unit 315 as user near the laundry appliance 100 in the crouched position or as user near the laundry appliance 100 in the standing position, as well as the reference values themselves, may depend on one or more among mass of the human body of the user, height of the human body of the user, expected maximum and minim distances at which the human body of the user is expected to be from the conductive element 160, and position of the conductive element 160 on the laundry appliance 100.

The mass and/or the height of the human body of the user, and/or the expected maximum and minim distances at which the human body of the user is expected to be from the conductive element 160 identify the above mentioned user parameters, and affect the capacitance value of the capacitor defined by the conductive element 160, the human body of the user and the dielectric (including the air) therebetween (particularly, the mass and height of the human body of the user affect the conductive surface "detected" or "intercepted" by the conductive element 160, whereas the expected maximum and minimum distances affect the distance between the conductive surface of the capacitor). By conductive surface detected or intercepted by the conductive element 160 (in the following also referred to as detected or intercepted conductive surface, for the sake of conciseness) is herein meant the conductive surface at/on which the electric field lines starting at the conductive element 160 end (see, for example, the electric field lines $\mathbf{450}_2$ represented in FIG. 4).

As mentioned above, these user parameters, or at least a subset thereof, may be set by the user, for example during a configuration phase of the laundry appliance 100, preferably by acting on the setting buttons provided on the user interface 150. These user parameters, or at least a subset thereof, may be set by any new user (i.e., in case of a change of user), with the laundry appliance 100 that may also store the user parameters of different users concurrently (so as to be able to distinguish the presence of more users in the same room).

Advantageously, a software wizard or setup assistant may present the user (e.g., through the display unit provided in the user interface 150) with a sequence of dialog boxes that lead the user through a series of steps for setting and/or adjusting and/or calibrating the user parameters; just as an example, these steps may comprise manual input of mass and height of the user, and/or positioning of the user in correspondence of the conductive element 160 at different distances (for example, at progressively increasing or progressively decreasing distances from the conductive element 160), and/or positioning of the user in correspondence of the conductive element 160 in different postures (for example, at least in the standing and crouched postures, and preferably also in one or more further postures between the standing and crouched postures).

In the embodiment herein considered in which the conductive element 160 is arranged at the door frame $\mathbf{135}_F$ (and particularly on the lower portion $\mathbf{135}_{FL}$ thereof), the user in the crouched posture identifies a detected or intercepted conductive surface that is larger than the detected or intercepted conductive surface identified by the user in the standing posture. Therefore, in this embodiment, the processing unit 315 is configured to determine that the user is in the crouched position if the electric signal is higher than a first reference value $V_{REF1}$ (see the portions of the electric signal denoted by the number references $\mathbf{605}_2$ and $\mathbf{605}_6$ in FIG. 6), and that the user is in the standing position if the electric signal is between the first reference value $V_{REF1}$ and a second reference value $V_{REF2}$ (see the portion of the electric signal denoted by the number reference $\mathbf{605}_4$ in FIG. 6). The second reference value $V_{REF2}$ may correspond to the baseline level, or, in the exemplary considered embodiment, it may be a value higher than the baseline level (but lower than the first reference value $V_{REF1}$); having a second reference value $V_{REF2}$ different from the base level could be advantageous for avoiding wrong interpretations by the processing unit 315—e.g., for avoiding that at least partially conductive bodies other than the human body of the user and capable of adding a significant contribution to the electric signal (such as pets or children) are wrongly interpreted as the presence of the user.

Just as another example, in the embodiment in which the conductive element 160 is near the user interface 150 (such as just below it, as visible in FIG. 1), the user in the standing posture would identify a detected or intercepted conductive surface that is larger than the detected or intercepted conductive surface identified by the user in the crouched posture. Therefore, in this embodiment, the processing unit 315 might be configured to determine that the user is in the standing position if the electric signal is higher than the first reference value $V_{REF1}$ (preferably, for a predetermined time period), and that the user is in the crouched position if the electric signal is (preferably, for a predetermined timer period) between the first reference value $V_{REF1}$ and the second reference value $V_{REF2}$ (i.e., with the relationships between the values of the electric signal and the first $V_{REF1}$ and second $V_{REF2}$ reference values that are substantially reversed with respect to the previous embodiment).

However, as mentioned above, the position of the conductive element 160 on the front structure 115 of the laundry appliance 100 shown in FIG. 1 is merely arbitrary; therefore, the above relationships may be changed accordingly. Moreover, same considerations apply if the conductive element 160 is placed on a part of the laundry appliance 100 other than the front structure 115 (for example, a side part or a top part thereof), the position of the conductive element 160 depending for example on the intended position of the laundry appliance 100 in the room (and, hence, on the direction from which the user is expected to approach the laundry appliance 100). According to embodiments of the present invention, not shown, different conductive elements may be provided on the front structure 115 and/or on other parts (for example, side and/or top parts) of the laundry appliance 100, a subset of (one or more of) the different conductive elements being for example enabled (for example, in the configuration phase) based on the position of the laundry appliance 100 in the room (and, hence, on the direction from which the user is expected to approach the laundry appliance 100).

As mentioned above, upon reception of the user presence/absence data (i.e., the indication, as determined by the processing unit 315, about the presence or absence of the user near the laundry appliance 100 and/or, when provided, his/her posture), the control unit 155 is configured to control the laundry appliance 100 accordingly. Preferably, the control unit 155 is configured to control the laundry appliance 100 with a first predetermined control mode (hereinafter also referred to as presence control mode) when the presence of the user near the laundry appliance 100 (and, eventually, his/her posture) is assessed, and with second predetermined control mode (hereinafter also referred to as absence control mode) when the absence of the user near the laundry appliance 100 is assessed. More preferably, the actions taken by the control unit 155 in the presence control mode (and discussed in greater detail here below) are protracted for a predetermined time interval or window after the processing unit 315 assesses a passage from presence to absence of the user near the laundry appliance 100 (or, otherwise stated, the control unit 155 is configured to keep controlling the laundry appliance 100 with the presence control mode for the predetermined time interval after the user has passed from being present to absent near the laundry appliance 100).

According to an embodiment of the present invention, the control of the display unit takes place as follows. In the presence control mode, the control unit 155 may be configured to control the laundry appliance 100 by turning on the display unit, and/or by displaying a specific type of information. For example, the display unit may output, as examples of types of information, information about a current phase of the ongoing treatment process (for example, the display unit may underline text corresponding to the ongoing treatment process to indicate that it is being currently performed), and/or information about a residual time to the end of the ongoing treatment process (in which case, the control unit 155 may advantageously be arranged for forcing a computation of the residual time to the end of the ongoing treatment process, and/or for forcing an update thereof despite of a default periodic update), and/or information about errors or maintenance suggestions for one or more components of the laundry appliances 100, and/or information about a current use mode of the laundry appliance 100 and/or information about a procedure of the current use mode of laundry appliance 100 (for example, in a case in which the laundry appliance 100 is being currently operated in a use mode corresponding to normal washing, the display unit may output information indicating that washing, rinsing, spin-drying, and drying procedures are being sequentially performed), and/or information for function setting (for example, the display unit may output one or more objects for setting functions, such as operation/pause, addition of laundry, schedule, air temperature and/or drying speed).

In the absence control mode, the control unit 155 may be configured to control the laundry appliance 100 by turning off the display unit or by decreasing a light intensity thereof (so as to save electric power).

According to an embodiment of the present invention, additional or alternative to the control of the display unit, the control of the light output device(s) takes place as follows. In the presence control mode, the control unit 155 may be configured to control the laundry appliance 100 by turning on the light output device, or by increasing a light intensity of the light emitted by the light output device and/or by changing a lighting frequency (for example, by setting an intermittent light with a high frequency so as to attract the attention of the user). In the absence control mode, the control unit 155 may be configured to control the laundry appliance 100 by turning off the light output device and/or by decreasing the light intensity of the light emitted by the light output device and/or by changing the lighting frequency of the light emitted by the light output device (for example, by setting an intermittent light with a low frequency). Additionally or alternatively to the above, in the example at issue in which the processing unit 315 is configured to determine also whether the user near the laundry appliance 100 is in the crouched posture or in the standing posture, the control unit 155 may be further configured to turn on the drum illumination system when the determined posture taken by the user is the crouched posture (in that, in this scenario, it is assumed that the user in the crouched posture is interested in visually checking the laundry load in the drum 110).

According to an embodiment of the present invention, additional or alternative to the control of the display unit and/or of the light output device discussed above, the control of the sound output device takes place as follows. In the presence control mode, the control unit 155 may be configured to control the laundry appliance 100 by turning off the sound output device (in order to avoid useless emission of sound when the user is near the laundry appliance 100 and can check personally certain types of notifications), or by decreasing a volume of the sound emitted by the sound output device and/or by increasing a quality of the sound emitted by the sound output device (for example, by widening a sampling interval of the sound emitted by the sound output device). In the absence control mode, the control unit 155 may be configured to control the laundry appliance 100 by turning on the sound output device and/or by increasing the volume of the sound emitted by the sound output device and/or by decreasing the quality of the sound emitted by the sound output device (for example, by narrowing the sampling interval of the sound emitted by the sound output device). Irrespective of the detected user presence or absence near the laundry appliance 100, in case that the sound output device outputs a notification sound and there is no user response for a predetermined time or more, the control unit 155 may change the type of the notification sound output by the sound output device or increase the volume of the notification sound.

According to an embodiment of the present invention, additional or alternative to the control of the display unit and/or of the light output device and/or of the light output device discussed above, the control of the connection device takes place as follows. In the presence control mode, the control unit 155 may be configured to control the laundry appliance 100 by turning off the connection device or by disabling the data exchange between the laundry appliance 100 and the remote unit. In the absence control mode, the control unit 155 may be configured to control the laundry appliance 100 by turning on the connection device or by enabling the data exchange between the laundry appliance 100 and the remote unit.

The data exchanged between the laundry appliance 100 and the remote unit may comprise notifications from the laundry appliance 100 to the user mobile terminal (and including, for example, one or more of the above information that can be displayed by the display unit, i.e. information about a current phase of the ongoing treatment process, information about a residual time to the end of the ongoing treatment process, information about errors or maintenance suggestions for one or more components of the laundry appliances, information about a current use mode of the laundry appliance and information about a procedure of the current use mode of laundry appliance). Additionally or alternatively, the data exchanged between the laundry appliance 100 and the remote unit may comprise control commands from the user mobile terminal to the laundry appliance 100, for example for remotely setting and/or controlling parameters of the treatment process (e.g., for remotely setting the treatment process, the start time of the treatment process, the desired duration of the treatment process, the desired air temperature and/or the desired drying speed, and/or for remotely checking a time to end of the treatment process, a humidity degree of the laundry load, and/or an amount of the laundry load).

Naturally, in order to satisfy local and specific requirements, a person skilled in the art may apply to the invention described above many logical and/or physical modifications and alterations. More specifically, although the invention has been described with a certain degree of particularity with reference to preferred embodiments thereof, it should be understood that various omissions, substitutions and changes in the form and details as well as other embodiments are possible. In particular, different embodiments of the invention may even be practiced without the specific details (such as the numeric examples) set forth in the preceding description for providing a more thorough understanding thereof; on the contrary, well known features may have been omitted or simplified in order not to obscure the description with unnecessary particulars.

The invention claimed is:

1. A laundry treatment appliance comprising:

a laundry treatment chamber configured to perform a treatment process on a laundry load housed therein;

a control unit configured to control the appliance;

a humidity measuring arrangement configured to measure a humidity of the laundry load, the humidity measuring arrangement comprising a sensing unit configured to sense an electric parameter associated with the laundry load, and a processing unit configured to determine the humidity of the laundry load according to the sensed electric parameter, the processing unit being in communication relationship with the sensing unit and with the control unit; and a conductive element electrically coupled to the processing unit, the conductive element being arranged on an appliance part such that, when an at least partially conductive body is in proximity of the conductive element, an electric signal is generated by capacitive coupling between the conductive element and the at least partially conductive body and is received by the processing unit;

wherein the processing unit is configured to assess a presence or absence of a user near the appliance according to a pattern of the electric signal at the processing unit, and the control unit is configured to control the appliance according to the assessed presence or absence of the user near the appliance.

2. The laundry treatment appliance according to claim 1, wherein the processing unit is configured to assess the presence of the user near the appliance if the electric signal at the processing unit is above a predetermined baseline signal level for at least a predetermined time period.

3. The laundry treatment appliance according to claim 1, wherein the control unit is configured to control the appliance with a predetermined control mode when the presence of the user near the appliance is assessed, the control unit being further configured to keep controlling the appliance with the predetermined control mode for a predetermined time interval after assessing a passage from presence to absence of the user near the appliance.

4. The laundry treatment appliance according to claim 1, wherein the processing unit is further configured to determine a posture taken by the user near the appliance according to a value of the electric signal, and the control unit is configured to control the appliance according to the determined posture taken by the user near the appliance.

5. The laundry treatment appliance according to claim 4, wherein said posture taken by the user near the appliance comprises a crouched posture or a standing posture, in the crouched posture the electric signal taking a first value in a first relationship with a first reference value and in the standing posture the electric signal taking a second value in a second relationship with the first reference value or with a second reference value different from the first reference value.

6. The laundry treatment appliance according to claim 5, wherein at least one between the first and second reference values and the first and second relationships depend on at least one among mass of a human body of the user, height of the human body of the user, expected maximum and minimum distances at which the human body of the user is expected to be from the conductive element, and position of the conductive element on the appliance.

7. The laundry treatment appliance according to claim 6, wherein at least one among said mass of the human body of the user, height of the human body of the user, and expected maximum and minimum distances at which the human body of the user is expected to be from the conductive element is settable by the user during a configuration phase of the appliance.

8. The laundry treatment appliance according to claim 5, wherein the conductive element is arranged on a door frame, and wherein in the first relationship the first value is higher than the first reference value and in the second relationship the second value is between the first reference value and the second reference value, the second reference value being lower than the first reference value.

9. The laundry treatment appliance according to claim 1, wherein:

the appliance comprises at least one of:

a display unit configured to display information to the user, a light output device configured to emit a light indicative of the treatment process or for attracting an attention of the user towards an appliance part, a sound output device configured to emit a sound indicative of the treatment process, and a connection device configured to allow a data exchange between the appliance and a remote unit; and wherein the control unit is configured to control the appliance by controlling at least one among:

a turning on or a turning off of the display unit, of the light output device and of the sound output device;

a type of information displayed by the display unit, when the display unit is turned on;

an intensity of the light emitted by the light output device;

a volume of the sound emitted by the sound output device;

a turning on or a turning off of the connection device, and/or an enabling or disabling of said data exchange between the appliance and the remote unit when the connection device is turned on.

10. The laundry treatment appliance according to claim 1, wherein the appliance comprises a display unit for displaying a type of information to the user, and wherein the type of information comprises at least one among:

information about a current phase of an ongoing treatment process;

information about a residual time to the end of the ongoing treatment process;

information about a current use mode of the laundry appliance;

information for function setting, and information about errors or maintenance suggestions for one or more appliance components.

11. The laundry treatment appliance according to claim 1, wherein:

the appliance comprises a light output device configured to emit a light indicative of the treatment process or for attracting an attention of the user towards an appliance part;

the processing unit is further configured to determine a posture taken by the user near the appliance according to a value of the electric signal, and the control unit is configured to control the appliance according to the determined posture taken by the user near the appliance;

said posture taken by the user near the appliance comprises a crouched posture or a standing posture, in the crouched posture the electric signal taking a first value in a first relationship with a first reference value and in the standing posture the electric signal taking a second value in a second relationship with the first reference value or with a second reference value different from the first reference value; and wherein the light output device comprises an illumination system configured to illuminate the laundry treatment chamber; and the control unit is configured to turn on the illumination system when the determined posture taken by the user near the appliance is the crouched posture.

12. The laundry treatment appliance according to claim 1, wherein the conductive element is electrically coupled to the processing unit by means of a conductive coupling.

13. The laundry treatment appliance according to claim 1, wherein the conductive element is electrically coupled to the processing unit by means of a capacitive coupling.

14. The laundry treatment appliance according to claim 1, further comprising a cabinet accommodating the laundry treatment chamber, wherein the cabinet comprises a front structure provided with a loading opening configured for accessing the laundry treatment chamber, the processing unit being mounted to the front structure at the loading opening.

15. The laundry treatment appliance according to claim 1, wherein the sensing unit comprises a first electric conductor of a humidity sensing capacitor and a second electric conductor of the humidity sensing capacitor, the laundry load acting as a dielectric of the humidity sensing capacitor.

* * * * *